US009382866B2

(12) United States Patent
Akita et al.

(10) Patent No.: US 9,382,866 B2
(45) Date of Patent: Jul. 5, 2016

(54) FUEL SUPPLIER

(71) Applicant: AISIAN KOGYO KABUSHIKI KAISHA, Obu-shi, Aichi-ken (JP)

(72) Inventors: Minoru Akita, Ama (JP); Naoyuki Tagawa, Nagoya (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 226 days.

(21) Appl. No.: 14/132,717

(22) Filed: Dec. 18, 2013

(65) Prior Publication Data

US 2014/0174403 A1 Jun. 26, 2014

(30) Foreign Application Priority Data

Dec. 21, 2012 (JP) ..... 2012-279196

(51) Int. Cl.
*F02M 39/02* (2006.01)
*F02D 41/38* (2006.01)
*F02D 41/30* (2006.01)

(52) U.S. Cl.
CPC ..... *F02D 41/3854* (2013.01); *F02D 41/3082* (2013.01); *F02D 2200/0602* (2013.01)

(58) Field of Classification Search
CPC ..... F02D 2041/2027; F02D 41/045; F02D 41/10; F02D 41/107; F02D 41/12; F02D 41/3082; F02D 41/3836; F02D 41/3845; F02D 41/3854; F02M 37/08; F02M 2037/087; F02M 57/027
See application file for complete search history.

(56) References Cited

U.S. PATENT DOCUMENTS 4,934,399 A * 6/1990 Cho ..... G05D 16/2013 137/14
5,749,344 A * 5/1998 Yoshiume ..... F02D 41/3082 123/399
6,014,955 A * 1/2000 Hosotani ..... F02D 41/0002 123/399
6,450,148 B2 9/2002 Nakamura et al.
6,666,191 B2 * 12/2003 Nakagawa ..... F02D 31/009 123/480
8,888,657 B2 * 11/2014 Kitao ..... E02F 9/2079 477/168
2012/0306416 A1 * 12/2012 Hano ..... B60L 1/003 318/400.26
2013/0136624 A1 * 5/2013 Kitao ..... E02F 9/2079 417/212
2014/0230791 A1 * 8/2014 Kojima ..... F02D 41/123 123/446
2015/0007798 A1 * 1/2015 Cho ..... F02M 69/02 123/495
2015/0159577 A1 * 6/2015 Akita ..... F02D 41/3082 123/497

FOREIGN PATENT DOCUMENTS

JP 6-74120 A 3/1994
JP 2001152992 A 6/2001
JP 2007285272 A 11/2007
JP 2008121563 A * 5/2008 ..... F02D 45/00

OTHER PUBLICATIONS

Korean Patent Application No. 2013-0128253, Notice of Grounds for Rejection dated Dec. 10, 2014, 8 pages.

* cited by examiner

*Primary Examiner* — Hung Q Nguyen
*Assistant Examiner* — Kevin R Steckbauer
(74) *Attorney, Agent, or Firm* — Conley Rose, P.C.

(57) ABSTRACT

A fuel supplier for a motor vehicle, having a fuel tank and an internal combustion engine, includes a fuel pump pumping fuel from the fuel tank to the internal combustion engine, a motor driving the fuel pump, and a control unit carrying out feedback control of duty ratio of voltage applied to the motor such that the actual fuel pressure comes close to a target fuel pressure. The control unit increases a low limit value of the duty ratio in accordance with the change of an accelerator open ratio in an opening direction.

5 Claims, 12 Drawing Sheets

| ACCELERATOR OPEN RATIO VARIATION[%] | 1.0 | 2.0 | 4.0 | 8.0 |
|---|---|---|---|---|
| LOW LIMIT GUARD VALUE (Da) [%] | 45 | 50 | 55 | 60 |

(DUTY LOW LIMIT VALUE[%])

| THROTTLE OPEN RATIO VARIATION[%] | 1.0 | 2.0 | 4.0 | 8.0 |
|---|---|---|---|---|
| INTEGRATION VALUE[%] | 0.1 | 1.52 | 2.66 | 10.0 |

| THROTTLE OPEN RATIO VARIATION[%] | 1.0 | 2.0 | 4.0 | 8.0 |
|---|---|---|---|---|
| SUBTRACTION VALUE[%] | 0.1 | 0.1 | 0.1 | 0.1 |

(NORMAL SUBTRACTION OPERATION)

| THROTTLE OPEN RATIO VARIATION[%] | 1.0 | 2.0 | 4.0 | 8.0 |
|---|---|---|---|---|
| SUBTRACTION VALUE[%] | 0.01 | 0.01 | 0.01 | 0.01 |

(SUBTRACTION VALUE DELAY OPERATION)

| | | VARIATION 1% | | | VARIATION 2% | | VARIATION 3% | |
|---|---|---|---|---|---|---|---|---|
| ACCELERATOR OPEN RATIO VARIATION (Acc) [100%/256] | 0 | 0.39 | 0.79 | 1.18 | 1.58 | 1.97 | 2.37 | 2.76 | 3.16 |
| OFFSET AMOUNT Base | 0 | 0.19 | 0.38 | 0.95 | 1.52 | 1.71 | 1.9 | 2.09 | 2.28 |

INFLATION AMOUNT MAP

| ACCELERATOR OPEN RATIO[%] | 0 | 20 | 40 | 60 | 80 | 99.2 |
|---|---|---|---|---|---|---|
| ACCELERATOR VALUE[%] | 0 | 10 | 20 | 30 | 40 | 50 |

| INFLATION VALUE[%] | 0 | 10 | 20 | 30 | 40 | 50 |
|---|---|---|---|---|---|---|
| RETENTION TIME[ms] | 0 | 100 | 150 | 200 | 250 | 300 |

FUEL SUPPLIER

CROSS-REFERENCE TO RELATED APPLICATIONS

This application claims priority to Japanese patent application serial number 2012-279196, filed on Dec. 21, 2012, the contents of which are incorporated herein by reference in its entirety.

STATEMENT REGARDING FEDERALLY SPONSORED RESEARCH OR DEVELOPMENT

Not applicable.

BACKGROUND

The present disclosure relates to a fuel supplier for an automobile, which has a fuel pump for pumping fuel from a fuel tank to an internal combustion engine, a motor for driving the fuel pump and a control unit. The control unit carries out feedback control of the duty ratio of the electric voltage applied to the motor such that the fuel pressure comes close to the target fuel pressure.

Japanese Laid-Open Patent Publication No. 2008-121563 discloses a common fuel supplier for an automobile. With respect to this fuel supplier, a target fuel pressure may be determined based on the engine load detected by signals from various sensors. Feedback control is then carried out such that actual fuel pressure is equal to the target fuel pressure.

In the situation where the actual fuel pressure is controlled to be equal to the target fuel pressure by feedback control, the motor is regulated such that the number of revolutions of the fuel pump becomes the requisite minimum number. This may occur, for example, when the accelerator is not pressed. In this condition, the actual fuel pressure is substantially equal to the target fuel pressure during an idling condition of the engine As shown in FIG. 13A, when the accelerator is pressed in order to drastically increase an open ratio, a throttle valve is opened, and the amount of intake air supplied to the internal combustion engine increases. When the amount of the intake air increases, the fuel amount injected into the engine increases. Therefore, as shown in FIG. 13B, the number of revolutions of the engine increases.

At this time, because the number of revolutions of the fuel pump is held at the requisite minimum by feedback control, the amount of supplied fuel is less than the amount of fuel consumption of the engine, and the fuel pressure decreases below the target fuel pressure. When deviation between the actual fuel pressure and the target fuel pressure is generated, a motor is controlled such that the number of revolutions of the fuel pump increases based on the deviation. Accordingly, the amount of fuel supplied to the engine increases.

During feedback control, the actual fuel pressure decreases below the target fuel pressure, the deviation generates, and then control is carried out in order to increase the umber of revolutions of the fuel pump. Thus, there is a time delay (TD) between pressing the accelerator and the increase in the number of revolutions of the engine. Accordingly, there has been a need for improved fuel suppliers.

BRIEF SUMMARY OF THE DISCLOSURE

In a first aspect of this disclosure, a fuel supplier for a motor vehicle having a fuel tank and an internal combustion engine has a fuel pump pumping fuel from the fuel tank to the internal combustion engine, a motor driving the fuel pump, and a control unit carrying out feedback control of the duty ratio of voltage applied to the motor such that a fuel pressure comes close to a target fuel pressure. The control unit increases a low limit value of the duty ratio depending on a change of an accelerator open ratio in an opening direction.

According to the first aspect, the low limit value of the duty ratio increases depending on the accelerator open ratio variation in the opening direction. Thus, the fuel pressure is identical to the target fuel pressure (deviation is zero). When a driver presses an accelerator in order to drastically increase speed in a condition that the duty ratio is retained at the low limit value by the feedback control, the low limit value of the duty ratio increases. Accordingly, the number of revolutions of the motor and the number of revolutions of the fuel pump simultaneously increase with the pressing of the accelerator. The amount of fuel pumped to the engine also increases. That is, even if pressing of the accelerator drastically increases the amount of fuel consumed in the internal combustion engine, it increases the amount of the fuel pumped to the internal combustion engine. Thus, it is able to decrease a drop in fuel pressure as compared with the target fuel pressure. As a result, acceleration performance of vehicle can be improved.

DETAILED DESCRIPTION

Each of the additional features and teachings disclosed above and below may be utilized separately or in conjunction with other features and teachings to provide improved fuel suppliers. Representative examples, which examples utilized many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the disclosure. Only the claims define the scope of the claimed invention. Therefore, combinations of features and steps disclosed in the following detailed description may not be necessary to practice the claimed invention in the broadest sense, and are instead included merely to particularly describe representative examples. Moreover, various features of the representative examples and the dependent claims may be combined in ways that are not specifically enumerated in order to provide additional useful embodiments of the present teachings.

A fuel supplier 10 according to an embodiment will be described based on FIGS. 1-8. The fuel supplier 10 is configured to supply fuel F from a fuel tank T of an automobile to an internal combustion engine E.

Figure 1:
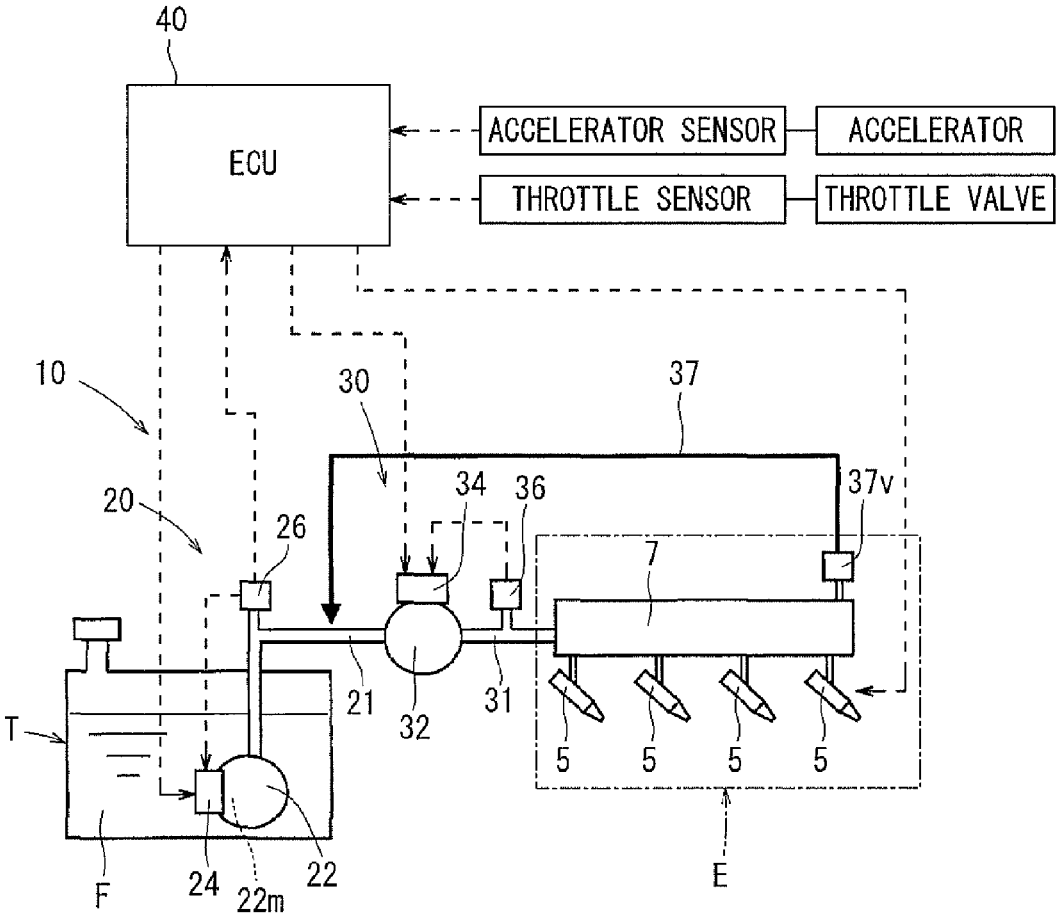
FIG. 1 is a schematic view of a fuel supplier according to an embodiment.

As shown in FIG. 1, the fuel supplier 10 has a low pressure fuel pump unit 20 and a high pressure fuel pump unit 30, which are connected to each other in series. The low pressure fuel pump unit 20 is configured to supply fuel to the high pressure fuel pump unit 30 at a predetermined pressure. The low pressure fuel pump unit 20 is connected to the high pressure fuel pump unit 30 via a low pressure fuel pipe 21. The low pressure fuel pump unit 20 is composed of a fuel pump 22, a motor 22*m*, a low pressure control unit 24 and a pressure sensor 26. The fuel pump 22 is disposed in the fuel tank T. The motor 22*m* is configured to drive the fuel pump 22. The low pressure control unit 24 controls the motor 22 based on signals from the engine control unit (ECU) 40. The pressure sensor 26 is attached to the low pressure fuel pipe 21 and is configured to detect a pressure P of fuel F discharged from the fuel pump 22. The low pressure control unit 24 carries out feedback control of the duty ratio of the voltage applied to the motor 22*m* such that the fuel pressure P of the fuel F discharged from the fuel pump 22 comes close to the target fuel pressure Ps determined by the ECU 40. In addition, the low pressure control unit 24 is configured to increase and/or decrease the low limit guard value that is the low limit of the duty ratio based on accelerator signals and throttle sensor signals transmitted from the ECU 40 as described below.

The high pressure pump unit 30 is configured to increase the pressure P of the fuel F supplied by the low pressure fuel pump unit 20 and to pump it to the engine E. The high pressure pump unit 30 is connected to a delivery pipe 7 of the engine E via a high pressure fuel pipe 31. The high pressure pump unit 30 is composed of a fuel pump 32, a high pressure control unit 34 and a pressure sensor 36. The high pressure control unit 34 controls the fuel pump 32 based on signals from the ECU 40. The pressure sensor 36 is attached to the high pressure fuel pipe 31 and is configured to detect the pressure of fuel discharged from the fuel pump 32. The high-pressure fuel supplied to the delivery pipe 7 of the engine E by the high pressure fuel pump unit 30 is jetted into a combustion chamber (not shown) of the engine E from a plurality of injectors 5 attached to the delivery pipe 7. Surplus fuel in the delivery pipe 7 is returned to the low pressure fuel pipe 21 via a valve 37*v* and a return pipe 37.

Figure 6A:
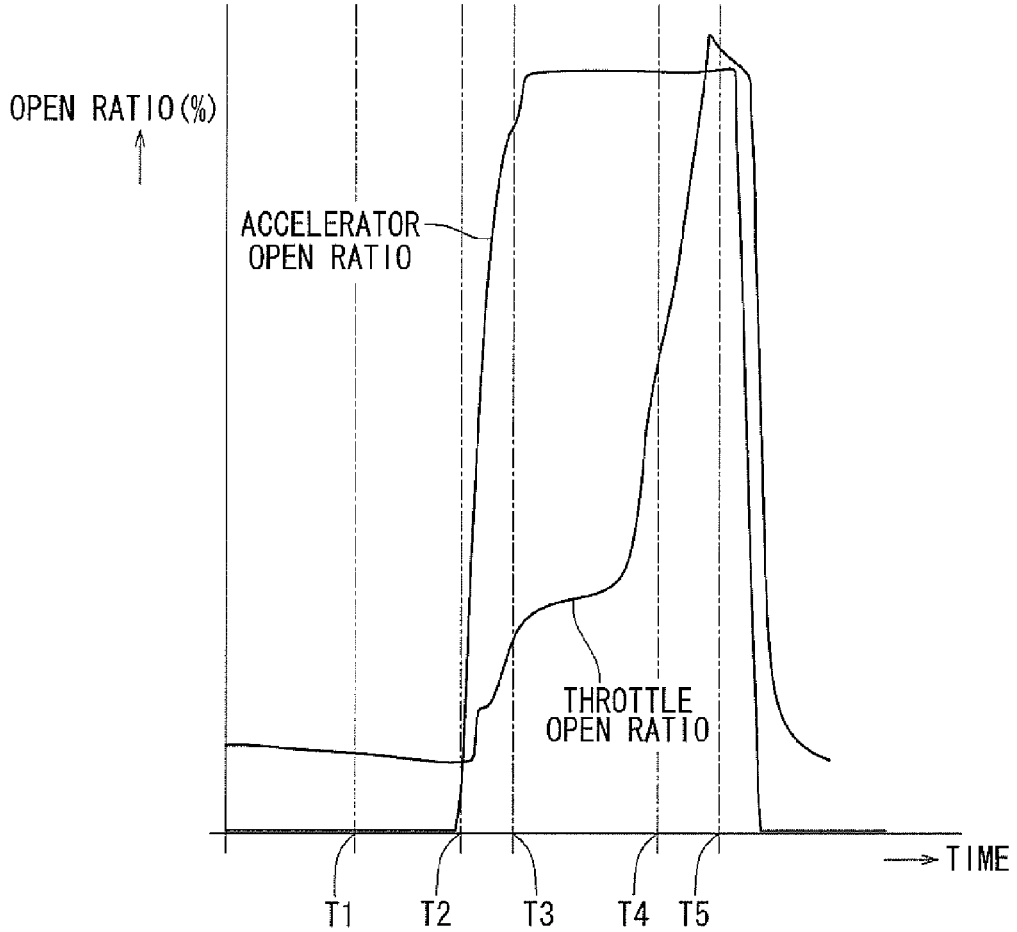
FIG. 6A is a graph showing the relationship between the accelerator open ratio and the throttle open ratio.
Figure 6B:
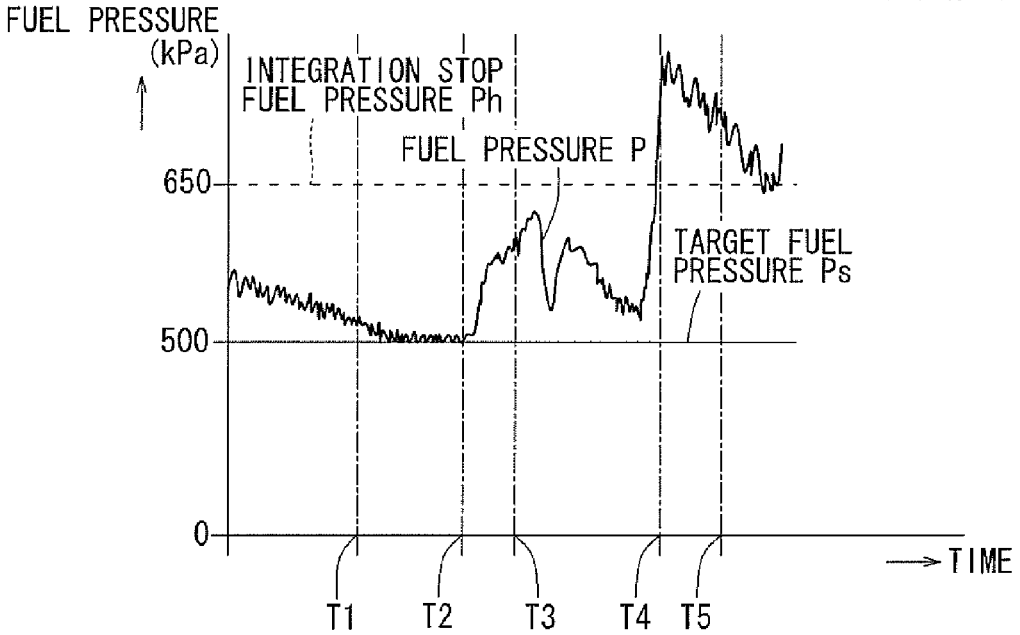
FIG. 6B is a graph showing the fuel pressure in the fuel supplier.
Figure 7:
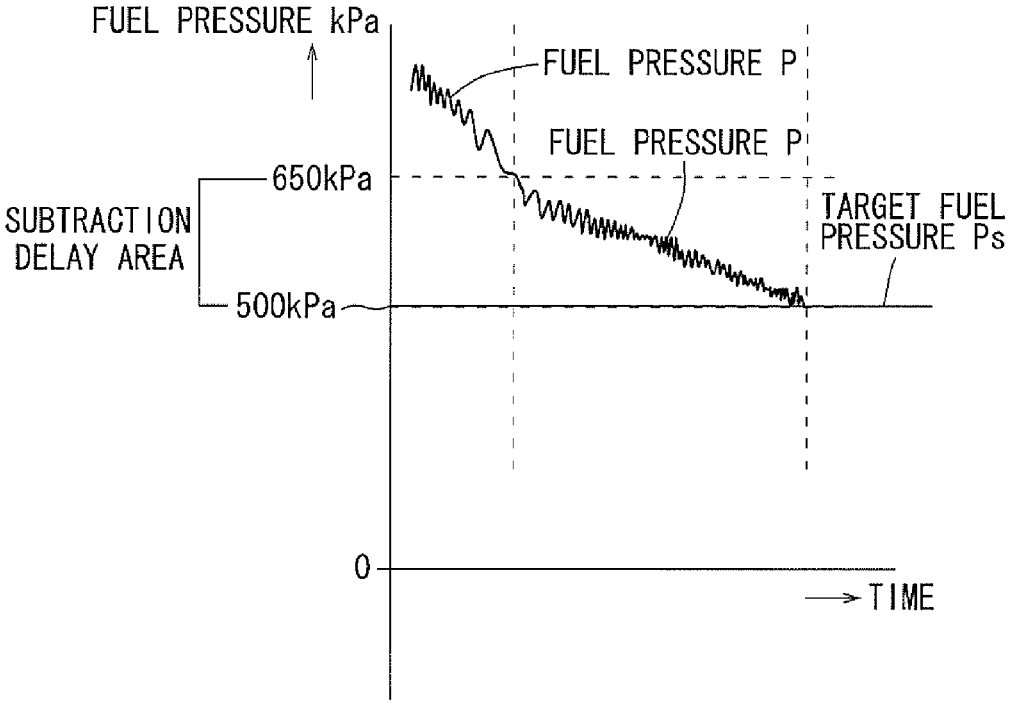
FIG. 7 is a graph showing the fuel pressure during the subtraction of the lower limit guard value.
Figure 8A:
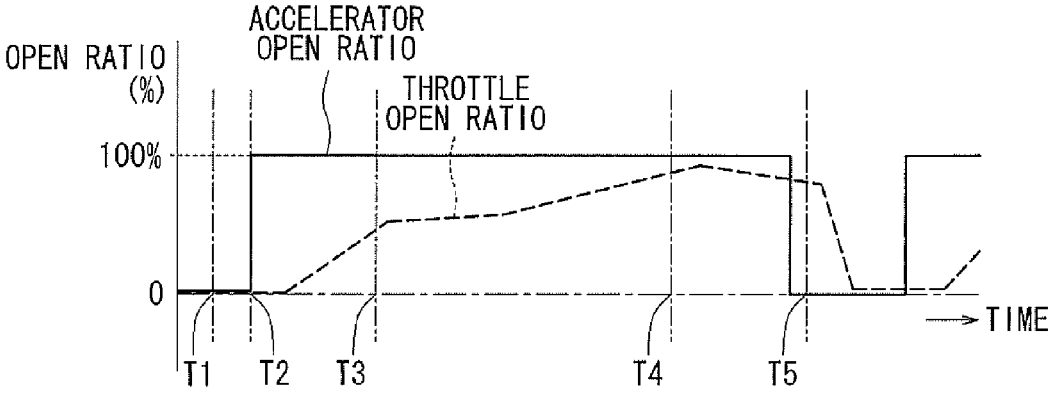
FIG. 8A is a graph showing the relationship between accelerator open ratio and throttle open ratio.
Figure 8B:
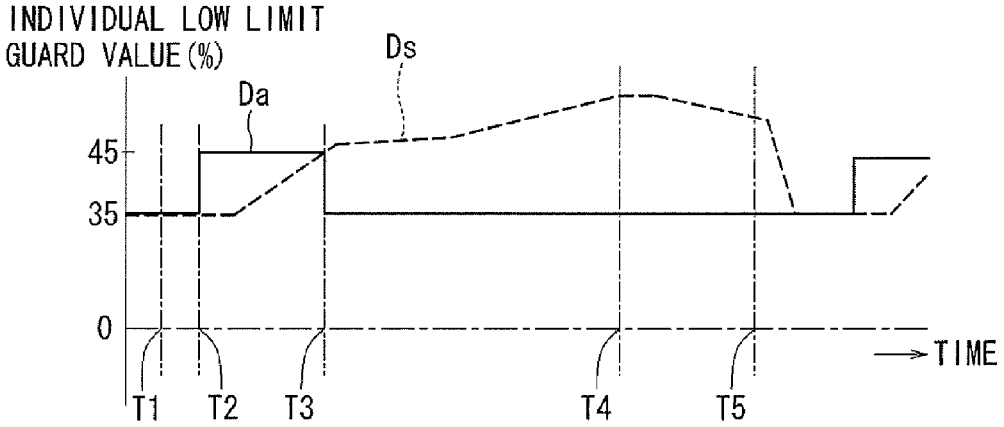
FIG. 8B is a graph showing a lower limit guard value based on the accelerator open ratio and a lower limit guard value based on the throttle open ratio.
Figure 8C:
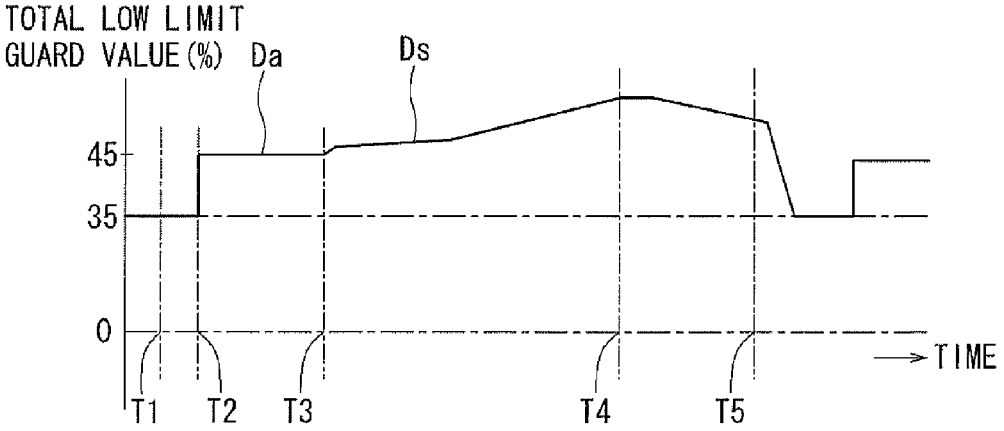
FIG. 8C is a graph showing a total lower limit guard value.

Fuel pressure control of the low pressure fuel pump unit 20 will be described in reference to flowcharts in FIGS. 2-5 and graphs in FIGS. 6-8. Processing of the flowcharts shown in FIGS. 2-5 is carried out, e.g., approximately every 5 milliseconds based on programs stored in the memory of a microcomputer of the low pressure control unit 24. That is, the low pressure control unit 24 corresponds to a control unit of this disclosure. Fuel pressure control in an idling state where an accelerator is not pressed, for example, at time T1 in FIGS. 6A-B 8A-C will be described. In this state, accelerator sensor signals from the ECU 40 show that the accelerator is not pressed. When the accelerator is not pressed, a throttle valve is nearly closed. Throttle signals from the ECU 40 show the open-close condition of the throttle valve. The throttle valve operates after the operation of the accelerator operation. At step S101 in FIG. 2, target fuel pressure Ps (e.g., 500 kPa) transmitted from the ECU 40 to the low pressure control unit 24 is compared with actual fuel pressure P detected by the pressure sensor 26, and the duty ratio of the voltage applied to the motor 22*m* is determined based on a resulting deviation. At time T1 in FIGS. 6A-B and 8A-C, output value (duty value) of feedback control becomes a minimum because the actual fuel pressure P is higher than the target fuel pressure (e.g., 500 kPa) (refer to FIG. 6B). At step S102, the low limit guard value is calculated based on accelerator open ratio. Such calculation of the low limit guard value based on accelerator open ratio is carried out according to the flowchart shown in FIG. 3A.

During calculation of the low limit guard value based on the accelerator open ratio, it is determined whether the low limit guard value based on the accelerator open ratio is inflated or not at step S201. Because the accelerator is not pressed (accelerator open ratio is zero), the step S201 determination is NO, the step S202 (accelerator speed-up) determination is NO, the step S206 (accelerator open ratio is less than 5%) determination is YES, and the low limit guard value Da is set at 35% at step S207. Then, it returns to step S103 in FIG. 2. At step S103 in FIG. 2, the low limit guard value based on the throttle open ratio is calculated. Calculation of the low limit guard value based on the throttle open ratio is carried out according to the flowchart shown in FIG. 4A. In the calculation of the low limit guard value based on the throttle open ratio, it is determined whether the throttle valve moves in an opening direction at step S301. At time T1 in FIGS. 6A-B and 8A-C, the operation goes through steps S305 and S306 and the low limit guard value is determined because the throttle valve does not move in the opening direction (S301 is determined as NO). That is, when the throttle open ratio is nearly zero, the subtraction value is also zero, and the initial value of the low limit guard value Ds (35%) is equal to the low limit guard value Ds (duty low limit value). Then, it returns to step S104 in FIG. 2. At step S104 in FIG. 2, the low limit guard value is determined. Low limit guard value Da (duty low limit value) is determined in step S102 (35%) based on the accelerator open ration. The low limit guard value Ds (duty low limit value) determined in step S103 (35%) is based on the throttle open ratio. The higher of these two values (Ds and Ds) is set as low limit guard value (refer to FIGS. 8B and C). At step S105 in FIG. 2, a driving duty ratio of the motor 22*m* of the fuel pump 22 is determined. In this operation, because the duty value based on the feedback control calculated in step S101 is less than the low limit guard value, the duty ratio of the motor 22*m* of the fuel pump 22 is set at 35% which corresponds to the low limit guard value.

Figure 2:
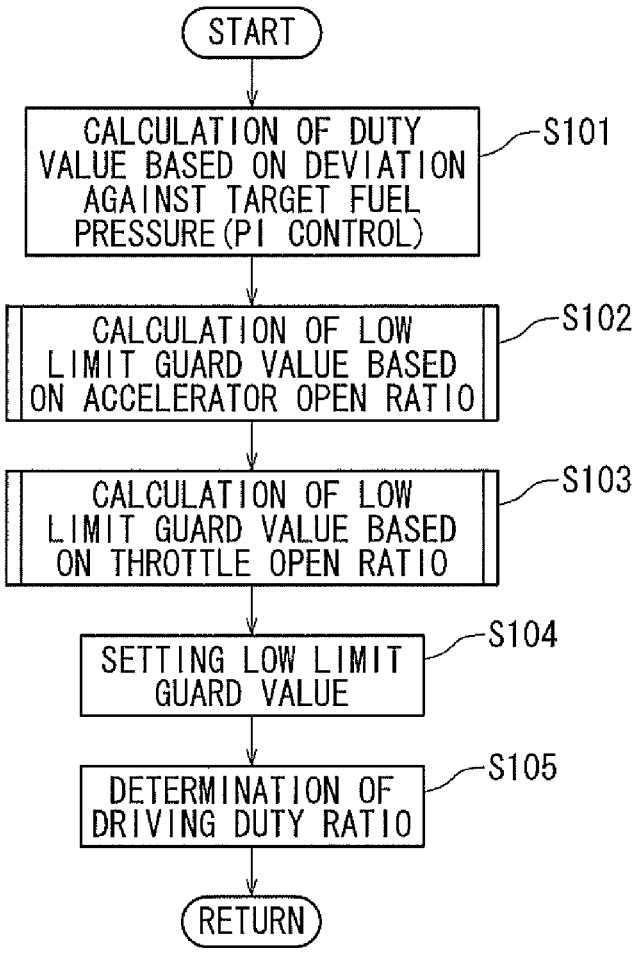
FIG. 2 is a flowchart showing the behavior of the fuel supplier.

In a state where the above-described operation is repeated every 5 milliseconds, pressing the accelerator shown in at time T2 in FIGS. 6A-B and 8A-C will be described. At time T2 the output value of feedback control (duty value) is at a minimum because the deviation between the target fuel pressure Ps and the actual fuel pressure P at step S101 in FIG. 2 is nearly zero (refer to FIG. 6B). Next, at step S102, the low limit guard value based on the accelerator open ratio is calculated. That is, it is determined whether the low limit guard value based on the accelerator open ratio is inflated at step S201 in FIG. 3A. Because it is a first operation after pressing the accelerator, the step S201 determination is NO, the step 202 (accelerator speed-up) determination is YES, and at step S203, it is determined whether the fuel pressure P is equal to or higher than 550 kPa and whether the duty value is less than 45%. Because the fuel pressure P being 500 kPa is nearly equal to the target fuel pressure Ps as shown in FIG. 6B (the step S203 determination is NO), the low limit guard value Da is calculated based on the accelerator open ratio variation (%) at step S205. That is, the low limit guard value Da is calculated based on a relationship diagram showing the relationship between the accelerator open ratio variation (%) and the low limit guard value Da in FIG. 3B. Here, the accelerator open ratio variation (%) is the amount of open ratio change during 5 ms in a state where the accelerator is 100% fully opened. For example, the accelerator open ratio variation (%)=1.0% means that the accelerator open ratio changes by 1.0% every 5 ms, i.e., the time required to fully open is 5 ms×100=500 ms=0.5 second. When the accelerator open ratio variation (%) is 1.0%, for example, the low limit guard value Da is set at 45%. In addition, if step S203 is determined to be YES, i.e., the fuel pressure P is equal to or higher than 550 kPa and the duty value is less than 45%, it is determined so as to speed-up shortly after fuel-cut and the low guard value Da is set at 60%.

Next, the calculation of the low limit guard value based on the throttle open ratio at step S103 in FIG. 2 is carried out. That is, at step S301 in FIG. 4A, it is determined whether the throttle valve moves in the opening direction. Because the throttle valve does not move in the opening direction at time T2 in FIGS. 6A-B and 8A-C (step S301 is determined to be NO), operation goes through steps S305 and S306 and the low limit guard value is determined. That is, when the throttle open ratio is nearly zero, the subtraction value is also zero, so that the initial value of the low limit guard value Ds (35%) is equal to the low limit guard value Ds. Then, a higher one of the low limit guard value Da (duty low limit value) based on the accelerator open ratio (45%) and the low limit guard value Ds (duty low limit value) based on the throttle open ratio (35%) is set at the low limit guard value at step S104 in FIG. 2. And, at step S105 in FIG. 2, because the duty value based on the feedback control calculated at step S101 is less than the low limit guard value as shown in FIGS. 8B and C, the duty ratio of the motor 22*m* of the fuel pump 22 is set at 45%, which corresponds to the low limit guard value.

Next, as shown at time T3 in FIGS. 6A-B and 8A-C, a condition where the throttle open ratio increases after the accelerator open ratio will be described. At time T3, because the actual fuel pressure P is higher than the target fuel pressure Ps (refer to FIG. 6B), the output value (duty value) of feedback control at step S101 in FIG. 2 becomes a minimum. Then, calculation of the low limit guard value based on the accelerator open ratio is carried out at step S102. That is, it is determined whether the low limit guard value based on the accelerator open ratio has been inflated at step S201 in FIG. 3A. At time T2, because the low limit guard value based on the accelerator open ratio is inflated, step S201 is determined to be YES. So, the low limit guard value based on the accelerator open ratio is not updated, and the low limit guard value Da (duty low limit value) based on the accelerator open ratio (45%), which was calculated in the previous process remains. Next, calculation of the low limit guard value based on the throttle open ratio is carried out at step S103 in FIG. 2. That is, at time T3 in FIGS. 6A-B and 8A-C, because step S301 in FIG. 4A is determined as YES, it is determined whether fuel pressure P is equal to or higher than 650 kPa at step S302. As shown in FIG. 6B, because the fuel pressure P is less than 650 kPa at time T3 (step S302 is determined as NO), integration value is calculated based on the throttle open ratio variation (%) at step S303. That is, the integration value is calculated based on the relationship diagram between the throttle open ratio variation (%) and the integration value in FIG. 4B. Here, the throttle open ratio variation (%) is the amount of open ratio change (in an opening direction) during 5 ms in a state where full opening of the throttle valve is 100%. The integration value refers to the duty value added by this time operation. For example, when the throttle open ratio variation (%) is 1.0%, the integration value is set at 0.1%. Then, at step S304, the integration value (for example, if Ds is 45%, it is 0.1%) is added to the low limit guard value Ds, which was calculated in the previous operation. That is, the low limit guard value Ds in this operation is 45.1%. Then, at step S104 in FIG. 2, one higher of the remained low limit guard value Da based on the accelerator open ratio (45%) and the low limit guard value Ds (duty low limit value) based on the throttle open ratio (45.1%) is set as the low limit guard value. When the low limit guard value Ds (duty low limit value) based on the throttle open ratio is higher than the low limit guard value Da based on the accelerator open ratio, the low limit guard value Da based on the accelerator open ratio is reset and is set at initial value (35%). In this operation the duty value is calculated at step S101. Because the duty value based on feedback control is less than the low limit guard value, the duty ratio of the motor 22*m* of the fuel pump 22 is set at 45.1% according to the low limit guard value at step S105 in FIG. 2.

Next, as shown at time T4 in FIGS. 6A-B and 8A-C, a condition where the fuel pressure P exceeds integration stop fuel pressure Ph, which is 650 kPa, will be described. At time T4, because the actual fuel pressure P is largely higher than the target fuel pressure Ps (refer to FIG. 6B), output value (duty value) of feedback control at step S101 in FIG. 2 becomes a minimum. Then, calculation of the low limit guard value based on the accelerator open ratio is carried out at step S102. That is, at step S201 in FIG. 3A, it is determined whether the low limit guard value based on the accelerator open ratio has been inflated. Because the low limit guard value based on the accelerator open ratio is reset at time T3, step S201 is determined to be NO. Because the accelerator open ratio constantly remains at 100% (refer to FIG. 8A), step 202 (accelerator speed-up) is determined to be NO, step 206

(accelerator open ratio is less than 5%) is determined to be NO, and thus the low limit guard value based on the accelerator open ratio is not renewed. However, because the low limit guard value based on the accelerator open ratio was reset at time T3, the low limit guard value Da based on the accelerator open ratio (duty low limit value) remains at the initial value (35%). At step S103 in FIG. 2 and calculation of the low limit guard value based on the throttle open ratio in FIG. 4A, it is determined whether the throttle valve moves in the opening direction at step S301 in FIG. 4A. At time T4 in FIGS. 6A-B and 8A-C, because the throttle valve moves in the opening direction (step S301 is YES), it is determined whether the fuel pressure P is higher than 650 kPa at step S302. As described above, the fuel pressure P is higher than the integration stop fuel pressure Ph, 650 kPa (step S302 is determined as YES), integration is not carried out. That is, despite the movement of the throttle valve in the opening direction, the low limit guard value Ds is held at the low limit guard value of the previous operation as shown in FIGS. 8B and C. Accordingly, addition of the low limit guard value is not carried out at step S104 in FIG. 2, and the duty ratio of the motor 22*m* of the fuel pump 22 is maintained at step S105. Thus, an increase in the fuel pressure P can be prevented.

Next, as shown at time T5 in FIGS. 6A-B and 8A-C, a condition where the throttle open ratio decreases (the throttle valve moves in the closing direction) will be described. At time T5, because the actual fuel pressure P largely exceeds the target fuel pressure Ps as shown in FIG. 6B, the output value (duty value) of feedback control at step S101 in FIG. 2 is a minimum. With respect to calculation of the low limit guard value based on the accelerator open ratio at step S102 in FIG. 2, step S201 is determined to be NO like time T4. Because the accelerator open ratio constantly remains at 0% (refer to FIG. 8A), step S202 is determined to be NO, and step S206 is determined to be YES. Accordingly, the low limit guard value Da based on the accelerator open ratio (duty low limit value) is set at 35%. With respect to step S103 in FIG. 2 and calculation of the low limit guard value based on the throttle open ratio in FIG. 4A, because the throttle valve moves in the closing direction, step S301 in FIG. 4A is determined to be NO. Accordingly, the subtraction value is calculated based on the throttle open ratio variation (%) at step S305. That is, the subtraction value is calculated based on a relationship diagram between the throttle open ratio variation (%) and the subtraction value of FIG. 4C. Here, the subtraction value is the duty value that is subtracted by this operation. For example, when the throttle open ratio variation (%) is 1.0%, the subtraction value is set at 0.1%. Then, at step S306, the subtraction value (0.1%) is subtracted from the low limit guard value Ds, which was calculated in the previous operation. In this way, the amount of fuel discharged from the fuel pump 22 decreases.

Figures 4A, 4B, 4C:
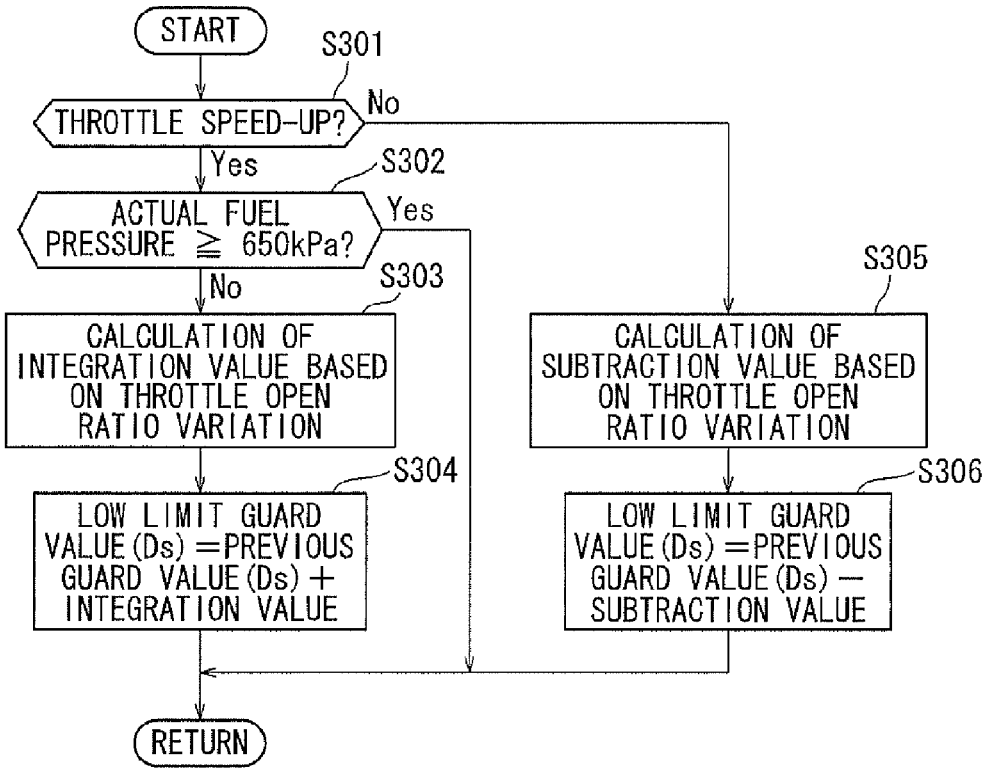
FIG. 4A is a flowchart showing the behavior of the fuel supplier in accordance with the throttle open ratio.
FIG. 4B is a relationship diagram showing the relationship between the amount of change of throttle open ratio and an integration value of the lower limit guard value.
FIG. 4C is a relationship diagram showing the relationship between the amount of change of throttle open ratio and a subtraction value of the lower limit guard value.
Figures 5A, 5B:
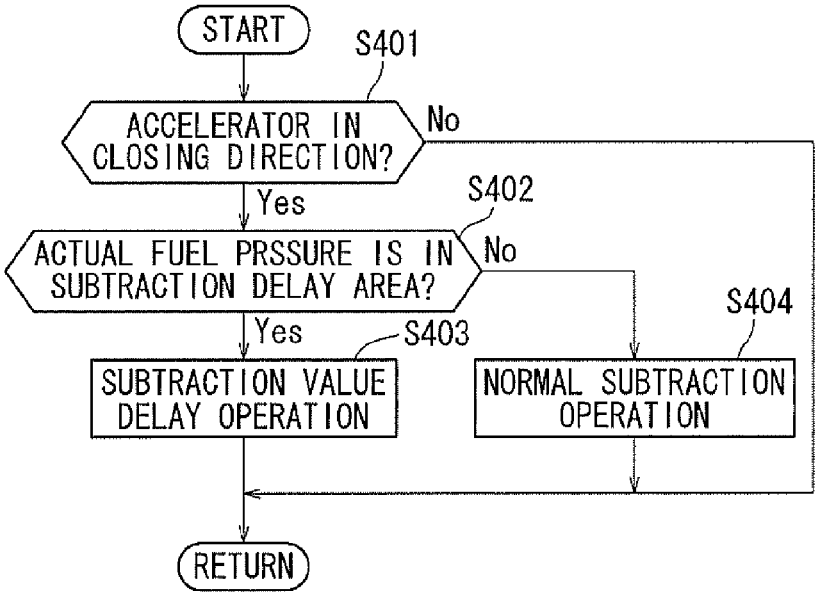
FIG. 5A is a flowchart showing the behavior of the fuel supplier in an accelerator closing direction.
FIG. 5B is a relationship diagram showing the relationship between the amount of change of throttle open ratio in the closing direction and the subtraction value of the lower limit guard value.

When the throttle valve changes in the closing direction, it is preferred to generate a difference of subtraction operation in accordance with the fuel pressure P as shown in the flowchart in FIG. 5. That is, in the situation at time T5 in FIGS. 6A-B and 8A-C, the fuel pressure P is higher than the integration stop fuel pressure Ph (650 kPa) (it is not in the subtraction delay area in FIG. 7). Accordingly, even if the subtraction operation of the low limit guard value Ds is not moderate, it is not believed that the fuel pressure P will decrease below the target fuel pressure Ps (500 kPa). Thus, step S402 is determined as NO. Accordingly, a normal subtraction operation is carried out at step S404. That is, as described above, the subtraction value is calculated based on the relationship diagram between the throttle open ratio variation (%) and the subtraction value of FIG. 4C. However, when the fuel pressure P is between the integration stop fuel pressure Ph (650 kPa) and the target fuel pressure Ps (500 kPa) (when the fuel pressure P is in the subtraction delay area in FIG. 7), it is preferred to slow the subtraction of the low limit guard value Ds such that the fuel pressure P does not go below the target fuel pressure Ps (500 kPa). Accordingly, when the fuel pressure P is in the subtraction delay area (step S402 is determined as YES), the subtraction value delay operation is carried out at step S403. That is, in the subtraction value delay operation, the subtraction value is calculated based on the relationship diagram between the throttle open ratio variation (%) and the subtraction value in FIG. 5B. For example, when the throttle open ratio variation (%) is 1.0%, the subtraction value is set at 0.01%. In this way, when the fuel pressure P is higher than the integration stop fuel pressure Ph (650 kPa), the fuel pressure decreases relatively quickly. However, when the fuel pressure P is in the subtraction delay area, the fuel pressure P decreases slowly.

Figures 3A, 3B:
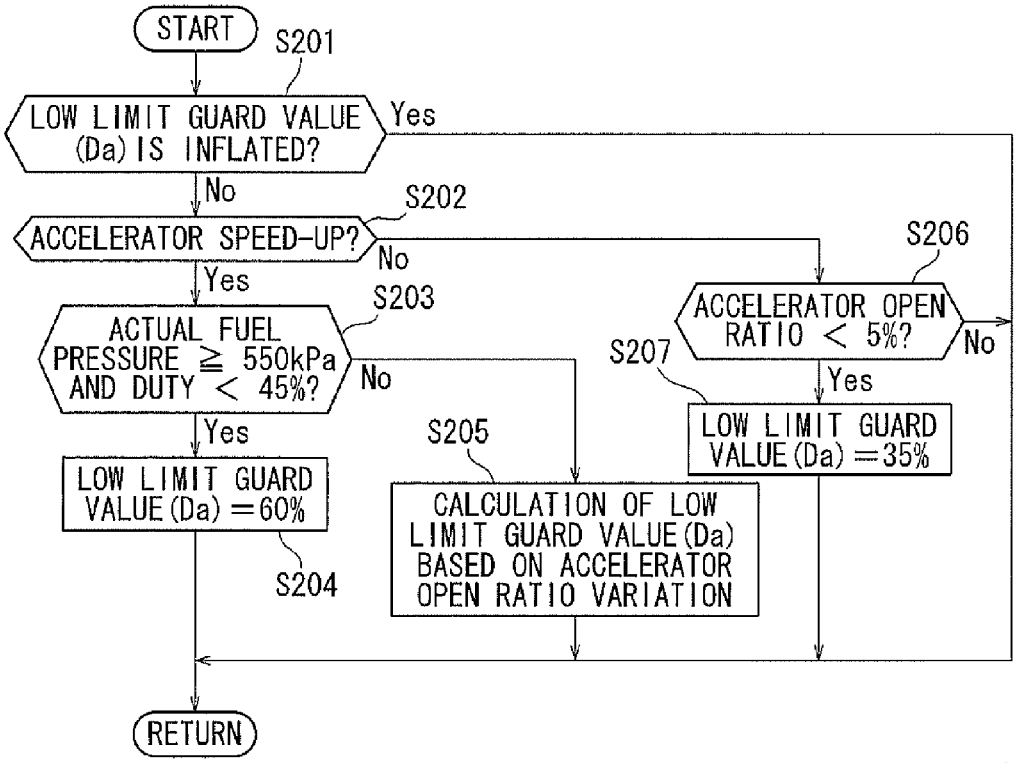
FIG. 3A is a flowchart showing the behavior of the fuel supplier in accordance with the open ratio of the accelerator.
FIG. 3B is a relationship diagram showing the relationship between the amount of change of accelerator open ratio and a lower limit guard value.

According to the fuel supplier 10 of this embodiment, when the accelerator of the automobile changes in the opening direction, the low limit value of the duty ratio (the low limit guard value) increases (refer to FIG. 3B). Thus, for example, in a case that the fuel pressure P is identical to the target fuel pressure Ps (the deviation is zero) and that the duty ratio is maintained at the low limit value due to the feedback control, when the operator presses the accelerator in order to suddenly accelerate the automobile, the low limit value of the duty ratio (low limit guard value) increases. Accordingly, the number of revolutions of the motor 22*m* and the number of revolutions of the fuel pump 22 increase simultaneously with the pressing of the accelerator, so that the amount of the fuel pumped to the engine E increases. That is, even if the amount of the fuel consumed in the engine suddenly increases in accordance with the pressing of the accelerator, the amount of the fuel pumped to the engine increases, so that it is able to suppress a drop in the fuel pressure P from the target fuel pressure Ps. Accordingly, characteristics of acceleration of the automobile can be improved. In addition, the low pressure control unit 24 (control unit) increases the low limit value of the duty ratio (low limit guard value) in accordance with the movement of the throttle valve, which controls the amount of intake air supplied to the engine, in the opening direction. That is, because the amount of the fuel consumed in the engine increases after the throttle valve opens in order to increase the amount of the intake air, it is able to increase the amount of the fuel pumped to the engine with proper timing. The low pressure control unit 24 (control unit) is configured to decrease the low limit value of the duty ratio (low limit guard value) in accordance with the changes of the throttle open ratio in the closing direction. Thus, when the throttle open ratio changes in the closing direction, it is able to decrease the amount of the fuel pumped to the engine and to suppress an increase in the fuel pressure. In the situation where the throttle valve moves in the closing direction, the amount of the fuel pumped to the engine decreases relatively quickly when the fuel pressure P is equal to or higher than the predetermined pressure (650 kPa). Also, the amount of the fuel pumped to the engine slowly decreases when the fuel pressure P is between the target fuel pressure Ps and the predetermined pressure (650 kPa). Accordingly, it is able to prevent the fuel pressure P from going below the target fuel pressure Ps.

Figures 9, 10:
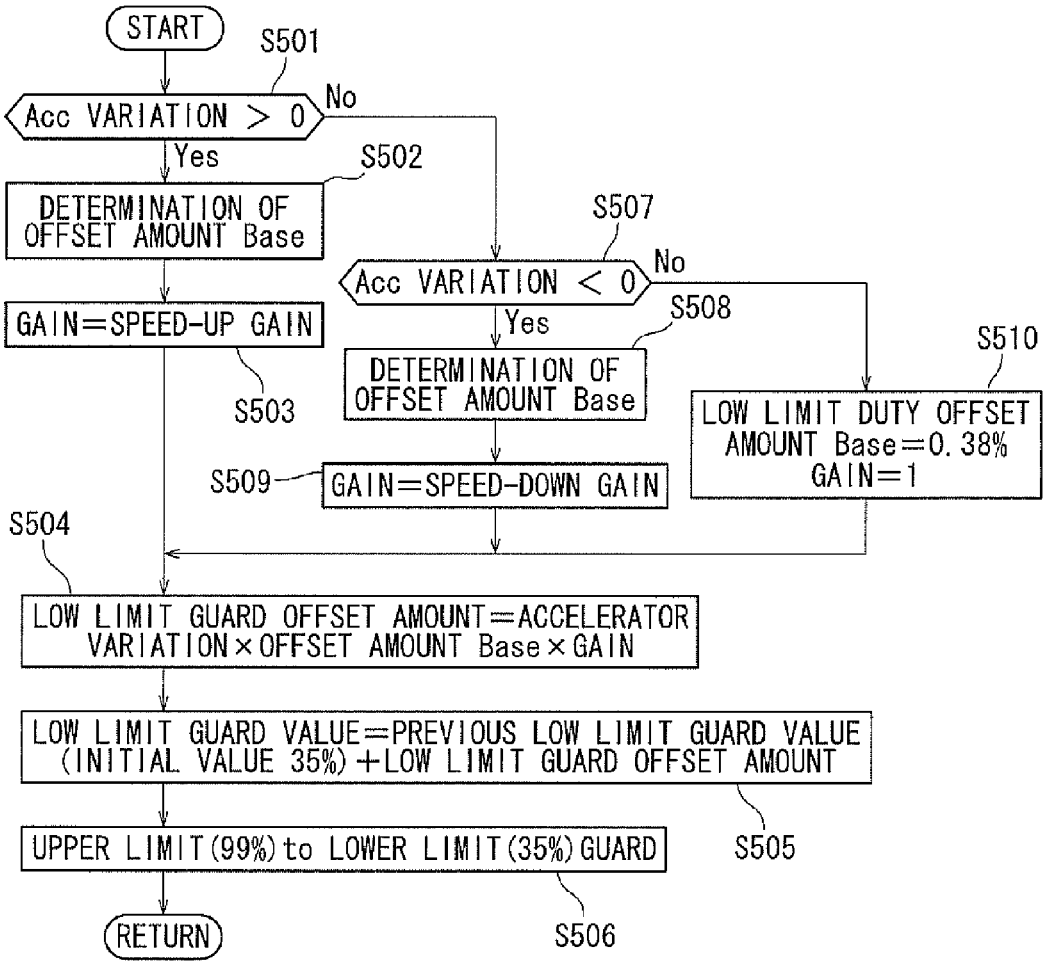
FIG. 9 is a flowchart showing the behavior of the fuel supplier according to an embodiment.
FIG. 10 is a relationship diagram showing the relationship between the amount of change in the accelerator open ratio and the offset volume base.

An embodiment of this disclosure will be described with reference to FIGS. 9 and 10. The fuel supplier of this embodiment has the same basic configuration as that of the fuel supplier 10 shown in FIG. 1, and only the method for controlling the duty ratio of the motor 22*m* of the fuel pump 22 is different. That is, with respect to the fuel supplier of this embodiment, the low limit guard value is determined depending on the accelerator open ratio variation (%) according to the flowchart shown in FIG. 9. The operation shown in FIG. 9 is repeated approximately every 5 ms based on the program stored in the memory of the microcomputer of the low pressure control unit 24. First, fuel pressure control in an idling condition where the accelerator is not pressed will be described. In this case, the accelerator open ratio variation (accelerator variation; Acc variation) is zero, so that step S501 is determined to be NO and step S507 is determined to be NO in FIG. 9. Thus, at step S510, the low limit duty offset amount Base is set at 0.38% and gain is set at 1. Then, at step S504, the low limit guard offset amount=the accelerator variation (0%)×the low limit duty offset amount Base (0.38%)×the gain (1) is calculated. That is, the low limit guard offset amount is zero. Then, at step S505, the low limit guard value (initial value, 35%) is added to the low limit guard offset amount of this time (0) in order to determine the low limit guard value (35%). At step S506, it is confirmed that the low limit guard value is between 99% and 35%. That is, in the idling condition that the accelerator is not pressed, the low limit guard value is 35%.

When the accelerator is pressed, the accelerator open ratio variation (Acc variation) becomes higher than zero, so that step S501 in FIG. 9 is determined to be YES. Thus, at step S502, the low limit duty offset amount Base is determined based on the relationship diagram between the accelerator open ratio variation and the low limit duty offset amount Base (refer to FIG. 10). Here, the accelerator open ratio variation in FIG. 10 is the accelerator open ratio variation during 5 ms, and it is shown by multiple number of 100%/256. For example, when the accelerator open ratio variation (%) is 1%, the microcomputer of the low pressure control unit 24 recognizes the variation 0.79% as 1%, and the low limit duty offset amount Base is set at 0.38. Then, at step S503, the gain is set as the speed-up gain. The speed-up gain has been set at 1.5 times. Then, at step S504, the low limit guard offset amount is calculated. That is, the low limit guard offset amount is equal to the accelerator variation (0.79%)×the low limit duty offset amount Base (0.38)×the gain (1.5)=0.45. Then, at step S505, the previous low limit guard value (35%) is added to the low limit guard offset amount of this time (0.45) in order to determine the low limit guard value (35.45%), and it is confirmed that the low limit guard value is between 99% and 35% at step S506. That is, when the accelerator is pressed, the low limit guard value is equal to a value in which the low limit guard offset amount (e.g., 0.45) is added to the initial value 35% every 5 ms. Due to this configuration, the amount of the fuel pumped to the engine increases simultaneously with the pressing of the accelerator, so that if the amount of the fuel consumed in the engine suddenly increases, it is able to suppress a drop in the fuel pressure P as compared to the target fuel pressure Ps.

When the accelerator open ratio variation (Acc variation) becomes less than zero by letting up on the accelerator, step S501 is determined to be NO and step S507 is determined to be YES in FIG. 9. Thus, at step S508, the low limit duty offset amount Base is determined based on the relationship diagram between the accelerator open ratio variation and the low limit duty offset amount Base (refer to FIG. 10). Here, when letting up on the accelerator, the accelerator open ratio changes in the closing direction, so that any sign of the low limit duty offset amount Base is minus (−); in other words, it has a negative value. For example, when the accelerator open ratio variation (%) is 1% (0.79%), the low limit duty offset amount Base is nearly equal to −0.38. Then, at step S509, the gain is set at speed-down gain. Here, the speed-down gain has been set at 2.0 times. Thus, at step S504, the low limit guard offset amount is equal to the accelerator variation (0.79%)×the low limit duty offset amount Base (about −0.38)×the gain (2.0) =about −0.6. Then, at step S505, the low limit guard value is determined by adding the previous low limit guard value to the low limit guard offset amount of this time (about −0.6), and it is confirmed that the low limit guard value is between 99% and 35% at step S506. That is, when letting up on the accelerator, the low limit guard value is equal to a value in which the low limit guard offset amount (e.g., 0.6) is subtracted every 5 ms from the low limit guard value on a moment in which the accelerator open ration variation (%) begins to become negative. Accordingly, when the accelerator open ratio changes in the closing direction, it is able to decrease the amount of the fuel pumped to the engine and to suppress increase in the fuel pressure.

Figures 11A, 11B:
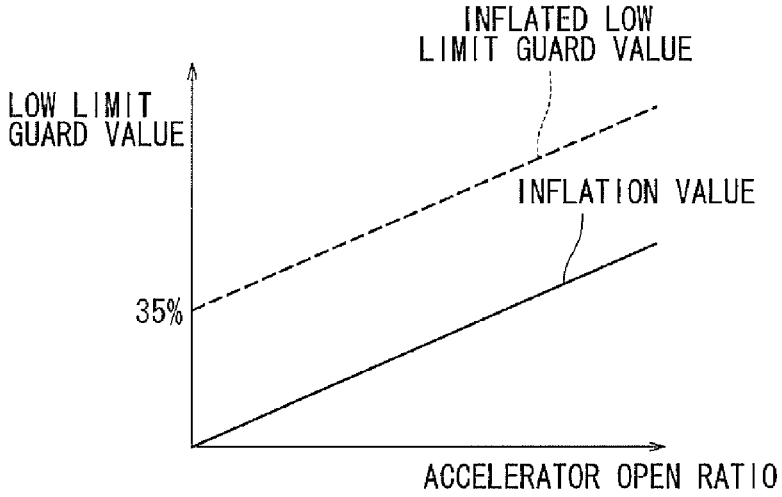
FIG. 11A is a graph showing the behavior of a fuel supplier according to an embodiment.
FIG. 11B is a relationship diagram showing the relationship between accelerator open ratio and the inflation value of the lower limit guard value.
Figures 12A, 12B:
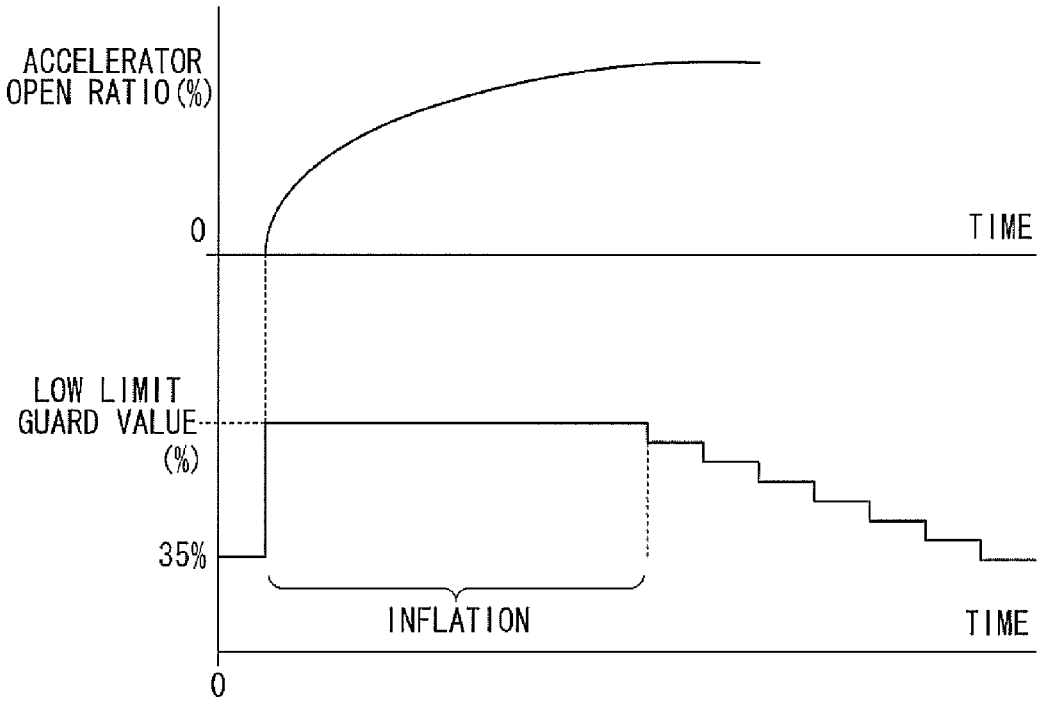
FIG. 12A is a graph showing the relationship between the accelerator open ratio and inflation value of the lower limit guard value in a fuel supplier according to a variant of the embodiment of FIG. 11A.
FIG. 12B is a relationship diagram showing the relationship between the inflation value of the lower limit guard value and the retaining time.
Figure 13A:
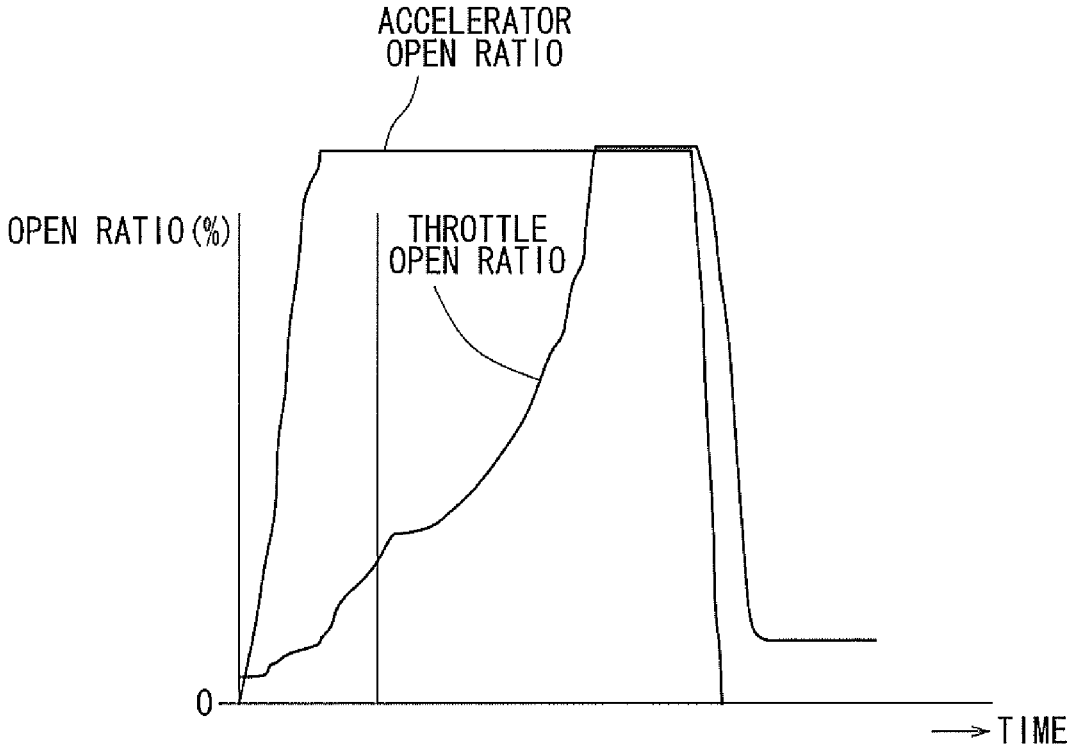
FIG. 13A is a graph showing the relationship between the accelerator open ratio and the throttle open ratio in a conventional fuel supplier.
Figure 13B:
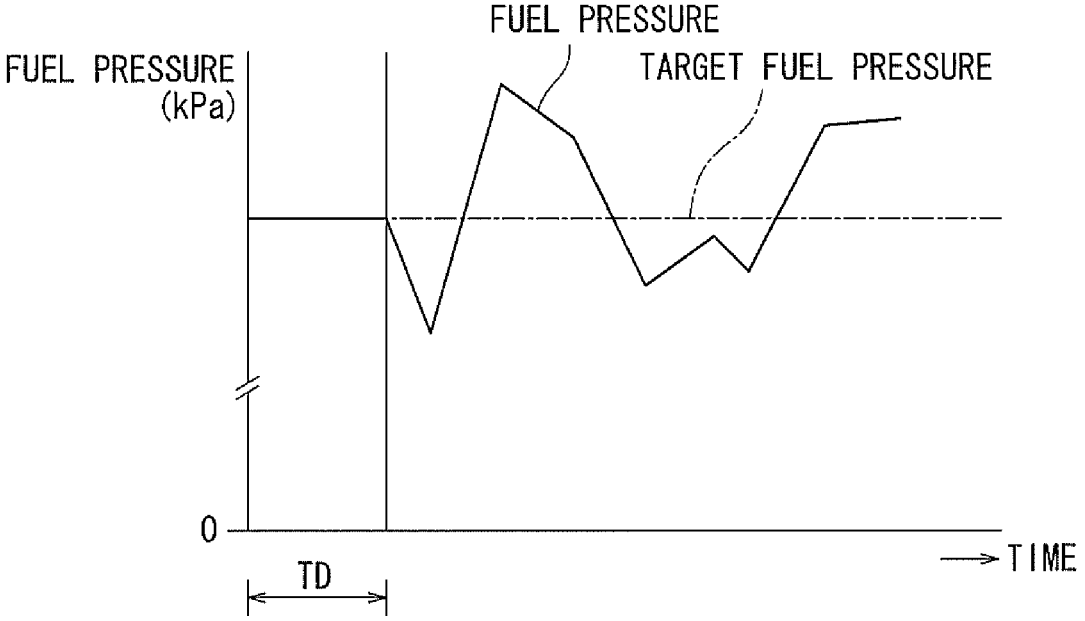
FIG. 13B is a graph showing the relationship between the actual fuel pressure and the target fuel pressure in the conventional fuel supplier.

This disclosure is not limited to the disclosed embodiments and can be modified without departing from the scope of the disclosure. For example, the low limit guard value is determined depending on the accelerator open ratio (%) in the embodiment of FIGS. 9 and 10. However, as shown in FIGS. 11A and B, an inflation value (%) is calculated depending on the accelerator open ratio (%) and the inflation value is added to the initial value of the low limit guard value (35%) in order to determine the low limit guard value depending on the accelerator open ratio (%). When the accelerator open ratio is 0%, the inflation value is 0%, for example as shown in FIG. 11B, so that the low limit guard value is equal to the initial value (35%)+the inflation value (0%)=35%. When the accelerator open ratio is 60%, the inflation value is 30%, so that the low limit guard value is equal to the initial value (35%)+the inflation value (30%)=65%. In particular, in the case of re-speed up after fuel cut caused by engine break during driving, it is preferred to use the low limit guard value based on the accelerator open ratio (%) (the initial value (35%)+the inflation value). When the inflation value (%) is determined based on the accelerator open ratio (%), it can be configured that retention time (ms) is determined depending on the inflation value (%) as shown in FIG. 12B, and that the inflation value (%) is decreased by the constant value every 5 ms. Also, while the initial value of the low limit guard value is set at 35% in the above described embodiments, it can be changed depending on such as characteristics of the motor 22*m* or the fuel pump 22. In addition, in the embodiments, the target fuel pressure and the integration stop fuel pressure Ph are set at 500 kPa and 650 kPa, respectively, however, they can be changed depending on driving condition of the motor vehicle, etc.

The invention claimed is:

1. A fuel supplier for a motor vehicle having a fuel tank and an internal combustion engine, comprising:

a fuel pump for pumping fuel from the fuel tank to the internal combustion engine;

a motor for driving the fuel pump; and a control unit for carrying out feedback control of duty ratio of a voltage applied to the motor such that actual fuel pressure comes close to a target fuel pressure;

wherein the control unit is configured to determine a low limit value of the duty ratio and set the duty ratio at the low limit value when the duty ratio calculated by the feedback control is less than the low limit value; and wherein the control unit is further configured to increase the low limit value of the duty ratio in response to a change of an accelerator open ratio in an opening direction.

2. The fuel supplier according to claim 1, wherein the control unit increases the low limit value of the duty ratio depending on a change of a throttle valve open ratio in an opening direction.

3. The fuel supplier according to claim 2, wherein the control unit increases the low limit value of the duty ratio depending on the change of the accelerator open ratio during a predetermined period of time when the accelerator open ratio changes in the opening direction, and then increases the low limit value of the duty ratio depending on the change of the throttle valve open ratio.

4. The fuel supplier according to claim 1, wherein the control unit is configured to decrease the low limit value depending on a change of the accelerator open ratio or the throttle valve open ratio in a closing direction.

5. The fuel supplier according to claim 4, wherein a decrease rate of the low limit value of the duty ratio, in a case that the actual fuel pressure is higher than the target fuel pressure and is less than a predetermined pressure, is less than a decrease rate of the low limit value of the duty ratio in a case that the actual fuel pressure is higher than the predetermined pressure.

* * * * *